US008522917B1

(12) United States Patent
Oh et al.

(10) Patent No.: US 8,522,917 B1
(45) Date of Patent: Sep. 3, 2013

(54) CELL PHONE SOUND AMPLIFYING EXTEND CUP

(76) Inventors: Kwang J Oh, La Crescenta, CA (US); Loren Oh, Irvine, CA (US); Austin Oh, Azusa, CA (US)

( * ) Notice: Subject to any disclaimer, the term of this patent is extended or adjusted under 35 U.S.C. 154(b) by 0 days.

(21) Appl. No.: 13/481,603

(22) Filed: May 25, 2012

(51) Int. Cl.
*G10K 11/00* (2006.01)

(52) U.S. Cl.
USPC ..... 181/192; 181/175; 181/148

(58) Field of Classification Search
USPC ..... 181/192, 175, 148
See application file for complete search history.

(56) References Cited

U.S. PATENT DOCUMENTS 7,878,296 B2 * 2/2011 Lee ..... 181/148
8,066,095 B1 * 11/2011 Bromer ..... 181/152
8,256,568 B2 * 9/2012 Lin ..... 181/179
8,327,974 B1 * 12/2012 Smith et al. ..... 181/175
2002/0009195 A1 * 1/2002 Schon ..... 379/454
2004/0086112 A1 * 5/2004 Hilger et al. ..... 379/455
2007/0102612 A1 * 5/2007 Seil et al. ..... 248/311.2
2008/0079388 A1 * 4/2008 Sarnowsky et al. ..... 320/103
2010/0219012 A1 * 9/2010 Baumbach ..... 181/177

* cited by examiner

*Primary Examiner* — Forrest M Phillips
(74) *Attorney, Agent, or Firm* — John K. Park; Park Law Firm

(57) ABSTRACT

A cell phone sound amplifying extend cup comprises a conical trumpet portion, an amplifying barrel portion, a first receptacle portion, a second receptacle portion and a net portion. The conical trumpet portion is for collecting and reflecting sound. The first receptacle portion is for receiving a mobile communication device of a first kind. The second receptacle portion is disposed for receiving a mobile communication device of a second kind. The net portion is disposed between the conical trumpet portion and the amplifying barrel portion for supporting the mobile communication device in place. The sound from the mobile communication device is collected and reflected in the conical trumpet portion and amplified in the amplifying barrel portion, such that the sound of the mobile communication device is delivered to a user far away from the mobile communication device.

16 Claims, 9 Drawing Sheets

CELL PHONE SOUND AMPLIFYING EXTEND CUP

BACKGROUND OF THE INVENTION

The present invention relates to a cell phone sound amplifying extend cup.

Cell phones are everywhere and everyone has at least one cell phone.

Cell phones are basically for carrying around all the time, but there are many occasions in which they cell phones are better be detached from the user and remained there. In such cases, since the cell phones are away from the users, sometimes it is not an easy thing to hear ring sounds of the cell phones.

Therefore, there should some way, which enables the user to recognize the incoming messages or text right away even though the cell phones are well away from him or herself.

Accordingly, a need for a means for sound amplifying in cell phone has been present for a long time considering the expansive demands in the everyday life. This invention is directed to solve these problems and satisfy the long-felt need.

SUMMARY OF THE INVENTION

The present invention contrives to solve the disadvantages of the prior art.

An object of the invention is to provide a cell phone sound amplifying extend cup.

A cell phone sound amplifying extend cup comprises a conical trumpet portion, an amplifying barrel portion, a first receptacle portion, a second receptacle portion and a net portion.

The conical trumpet portion is for collecting and reflecting sound.

The amplifying barrel portion extends from the conical trumpet portion.

The first receptacle portion is disposed in the amplifying barrel portion for receiving a mobile communication device of a first kind. The second receptacle portion is disposed in the amplifying barrel portion for receiving a mobile communication device of a second kind.

The net portion is disposed between the conical trumpet portion and the amplifying barrel portion for supporting the mobile communication device in place.

The sound from the mobile communication device is collected and reflected in the conical trumpet portion and amplified in the amplifying barrel portion, such that the sound of the mobile communication device is delivered to a user far away from the mobile communication device.

The conical trumpet portion may have an opening in a top portion, and the opening may be configured for passing wires extending from the mobile communication device.

The amplifying barrel portion may be substantially cylindrical.

The amplifying barrel portion may be transparent.

The amplifying barrel portion may comprise a lower section and an upper section connected in telescopic structure so as to have two states of folded and extended.

The amplifying barrel portion may further comprise a stopper provided between the lower and upper sections for keeping the lower and upper sections from disengaging.

The lower section may comprise an edge tilted inward.

The first receptacle portion may comprise two edge holders in a first diametrical direction.

Each of two edge holders may comprise two protrusions protruding inward.

The second receptacle portion may comprise two edge holders in a second diametrical direction.

Each of two edge holders may comprise two protrusions protruding outward.

The net portion may partially cover an opening in a top portion of the conical trumpet portion. The net portion may be resilient.

The cell phone sound amplifying extend cup may further comprise a weight portion disposed around the conical trumpet portion.

The weight portion may be integrated with the conical trumpet portion.

The weight portion may be adapted to be inserted to a cup holder of an automobile.

The advantages of the present invention are: (1) the cell phone sound amplifying extend cup according to the invention amplifies the ring sound of a personal electronic devices including a cellular phone; (2) the cell phone sound amplifying extend cup can accept the devices of different sizes; and (3) the cell phone sound amplifying extend cup is easy to be installed and used.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Figure 1:
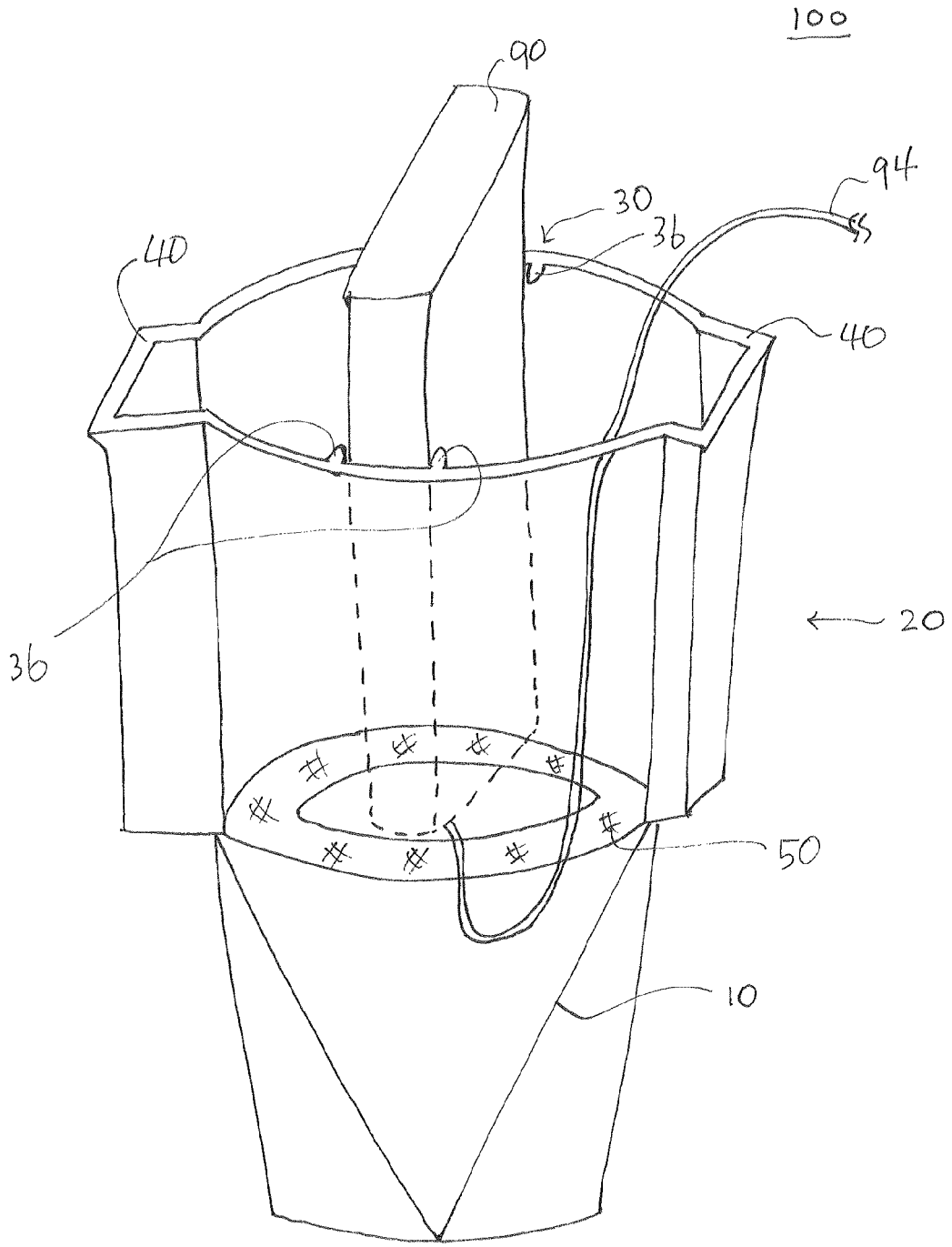
FIG. 1 is a perspective view showing a cell phone sound amplifying extend cup according to an embodiment of the invention.

FIGS. 1-11 show a cell phone sound amplifying extend cup according to embodiments of the invention.

An aspect of the invention provides a cell phone sound amplifying extend cup 100, comprising a conical trumpet portion 10, an amplifying barrel portion 20, a first receptacle portion 30, a second receptacle portion 40, and a net portion 50.

The conical trumpet portion 10 is for collecting and reflecting sound.

The amplifying barrel portion 20 extends from the conical trumpet portion 10.

The first receptacle portion 30 is disposed in the amplifying barrel portion 20 for receiving a mobile communication device 90 of a first kind as in FIG. 1. The second receptacle portion 40 is disposed in the amplifying barrel portion 20 for receiving a mobile communication device 92 of a second kind as in FIG. 3.

The net portion 50 is disposed between the conical trumpet portion 10 and the amplifying barrel portion 20 for supporting the mobile communication device 90, 92 in place.

The sound from the mobile communication device 90, 92 is collected and reflected in the conical trumpet portion 10 and amplified in the amplifying barrel portion 20, such that the sound of the mobile communication device 90, 92 is delivered to a user far away from the mobile communication device 90, 92.

Figure 2:
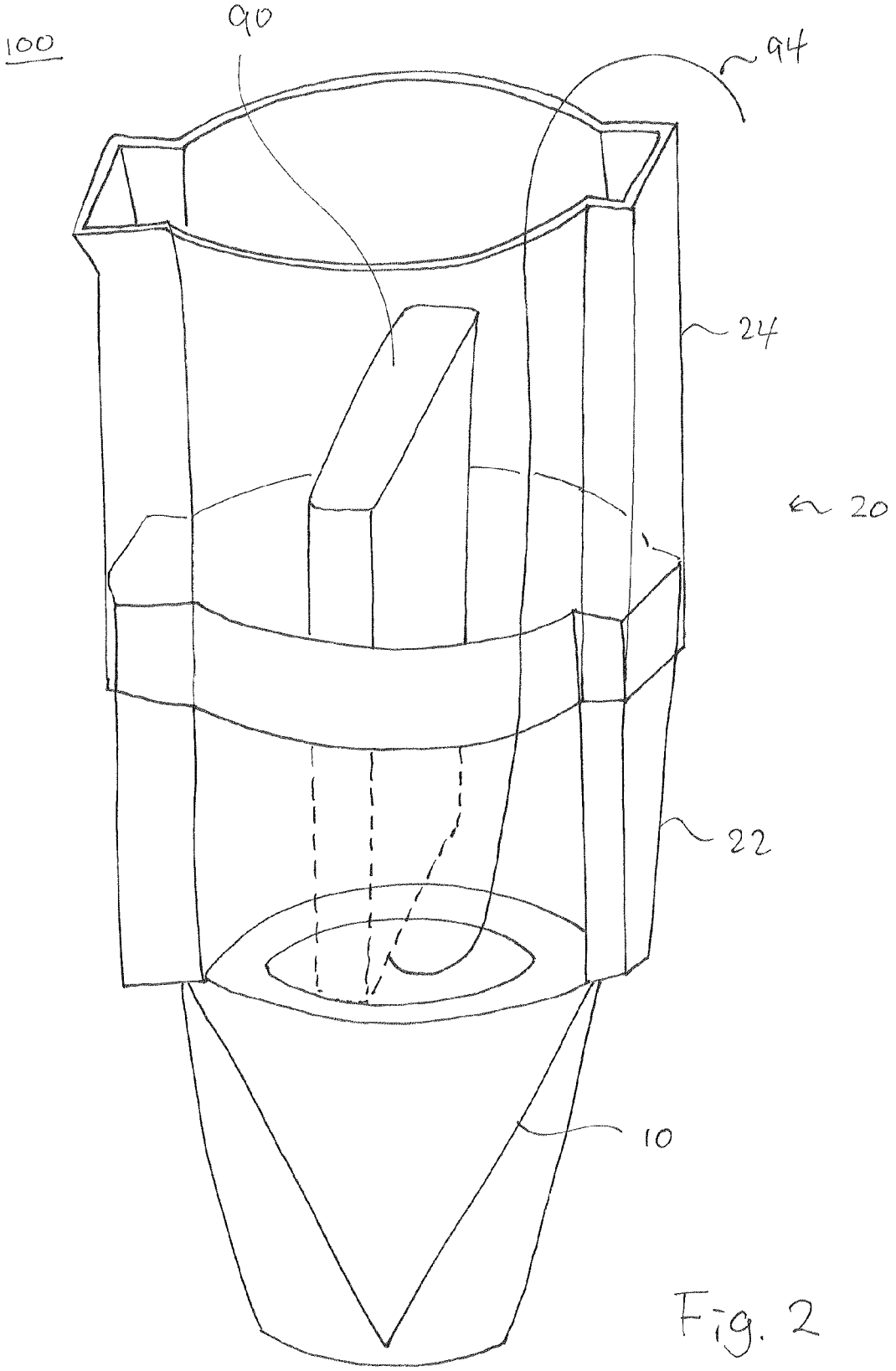
FIG. 2 is another perspective view showing the cell phone of FIG. 1 with telescopic structure extended.

The conical trumpet portion 10 may have an opening 12 in a top portion, and the opening 12 may be configured for passing wires 94 extending from the mobile communication device 90, 92 as shown in FIGS. 1 and 2.

The amplifying barrel portion 20 may be substantially cylindrical.

The amplifying barrel portion 20 may be transparent, such that the user may be able to see the mobile communication device 90, 92 even through it.

The amplifying barrel portion 20 may comprise a lower section 22 and an upper section 24 connected in telescopic structure so as to have two states of folded and extended as shown in FIGS. 2-5 and 9-11.

The amplifying barrel portion 20 may further comprise a stopper 60 provided between the lower and upper sections 22, 24 for keeping the lower and upper sections 22, 24 from disengaging. In certain embodiments of the invention, the stopper 60 may comprise a protrusion and a groove or hole provided in the lower and upper sections 22, 24, respectively. The protrusion may be a retractable ball.

The lower section 22 may comprise an edge tilted inward. The inwardly-tilted edge may facilitate the personal mobile communication device 90, 92 to slide in and out over it.

Figure 5:
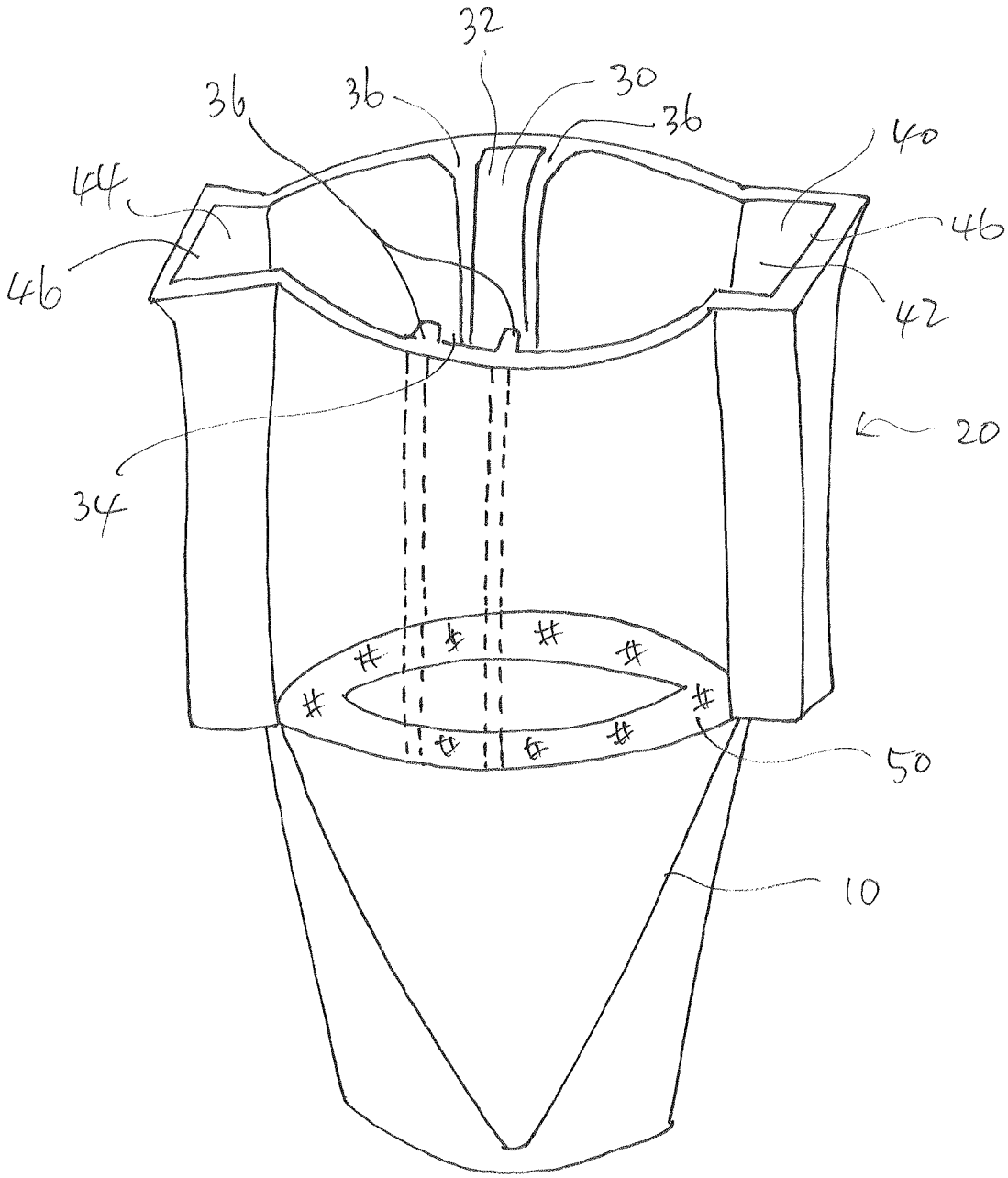
FIG. 5 is a perspective view showing a cell phone sound amplifying extend cup according to another embodiment of the invention.

The first receptacle portion 30 may comprise two edge holders 32, 34 in a first diametrical direction. Each of two edge holders 32, 34 may comprise two protrusions 36 protruding inward as shown in FIG. 5.

The second receptacle portion 40 may comprise two edge holders 42, 44 in a second diametrical direction. Each of two edge holders 42, 44 may comprise two protrusions 46 protruding outward as in FIG. 5.

The net portion 50 may partially cover an opening 12 in a top portion of the conical trumpet portion 10. The net portion 50 may be resilient.

Figure 9:
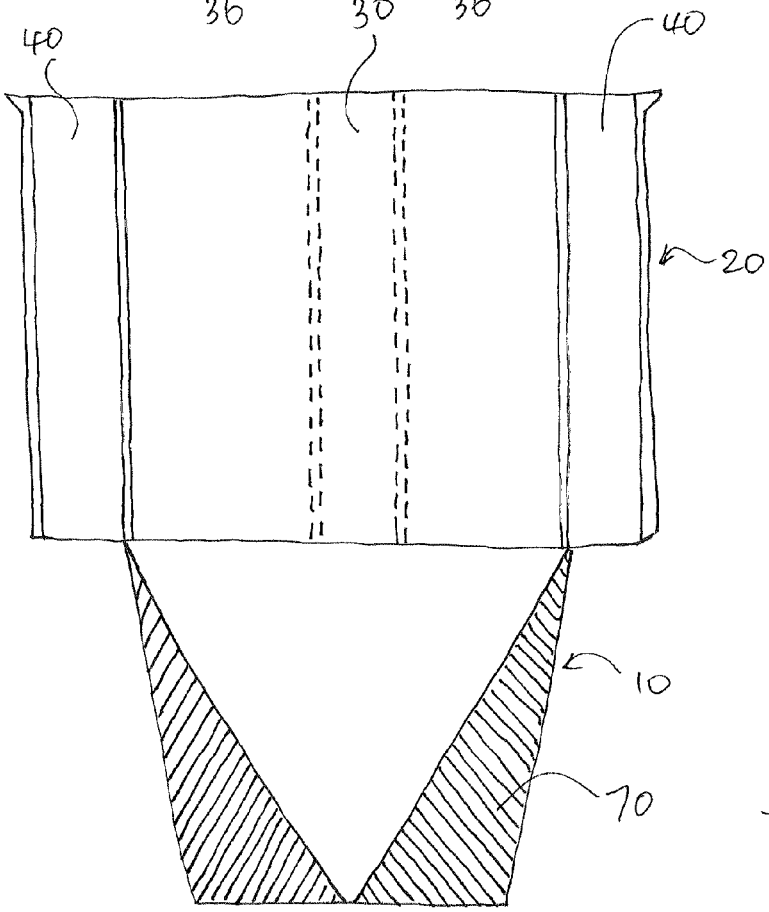
FIG. 9 is a front view of the cell phone sound amplifying extend cup of FIG. 8.
Figure 10:
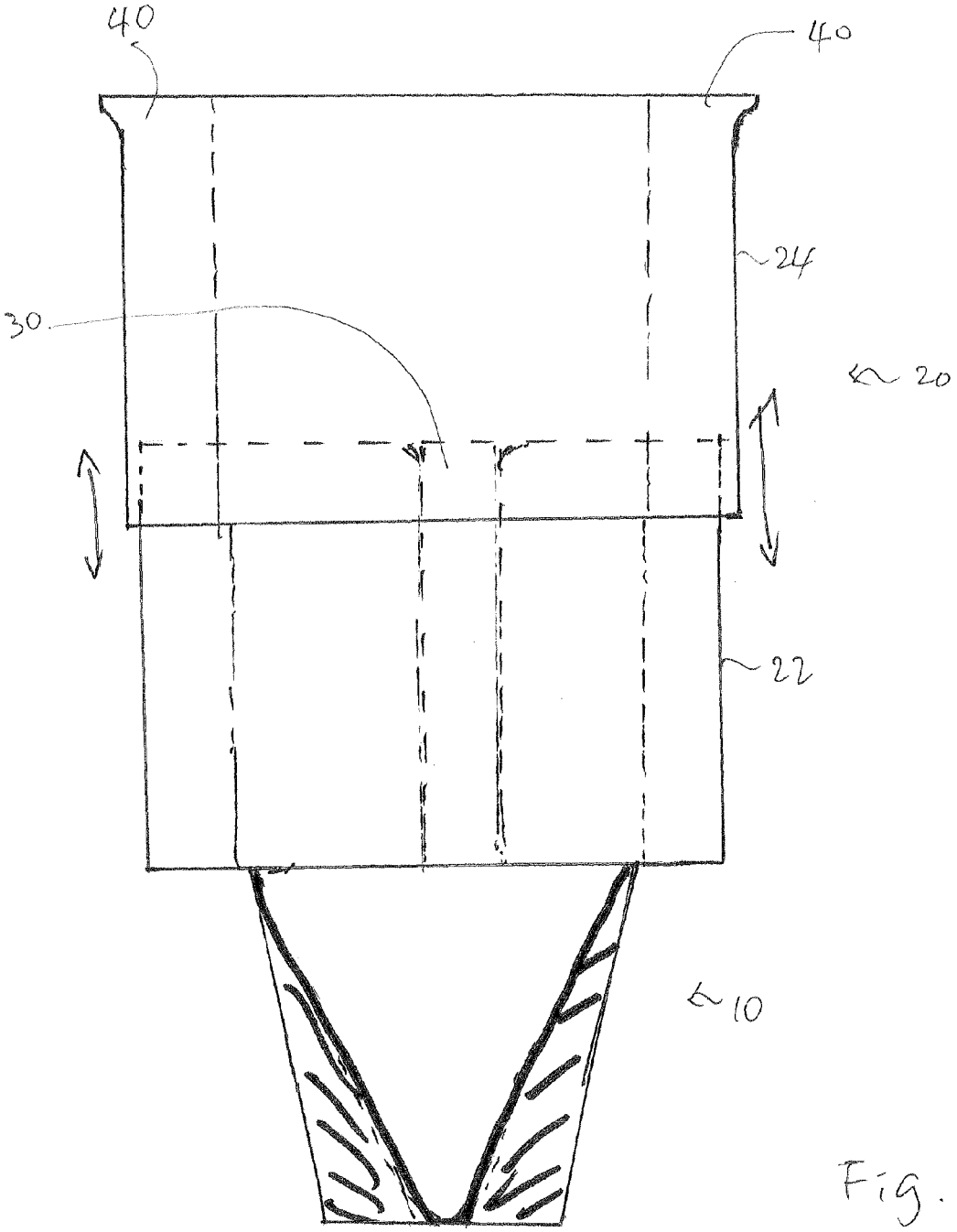
FIG. 10 is another front view of the cell phone sound amplifying extend cup of FIG. 9 with telescopic structure extended according to another embodiment of the invention.
Figure 11:
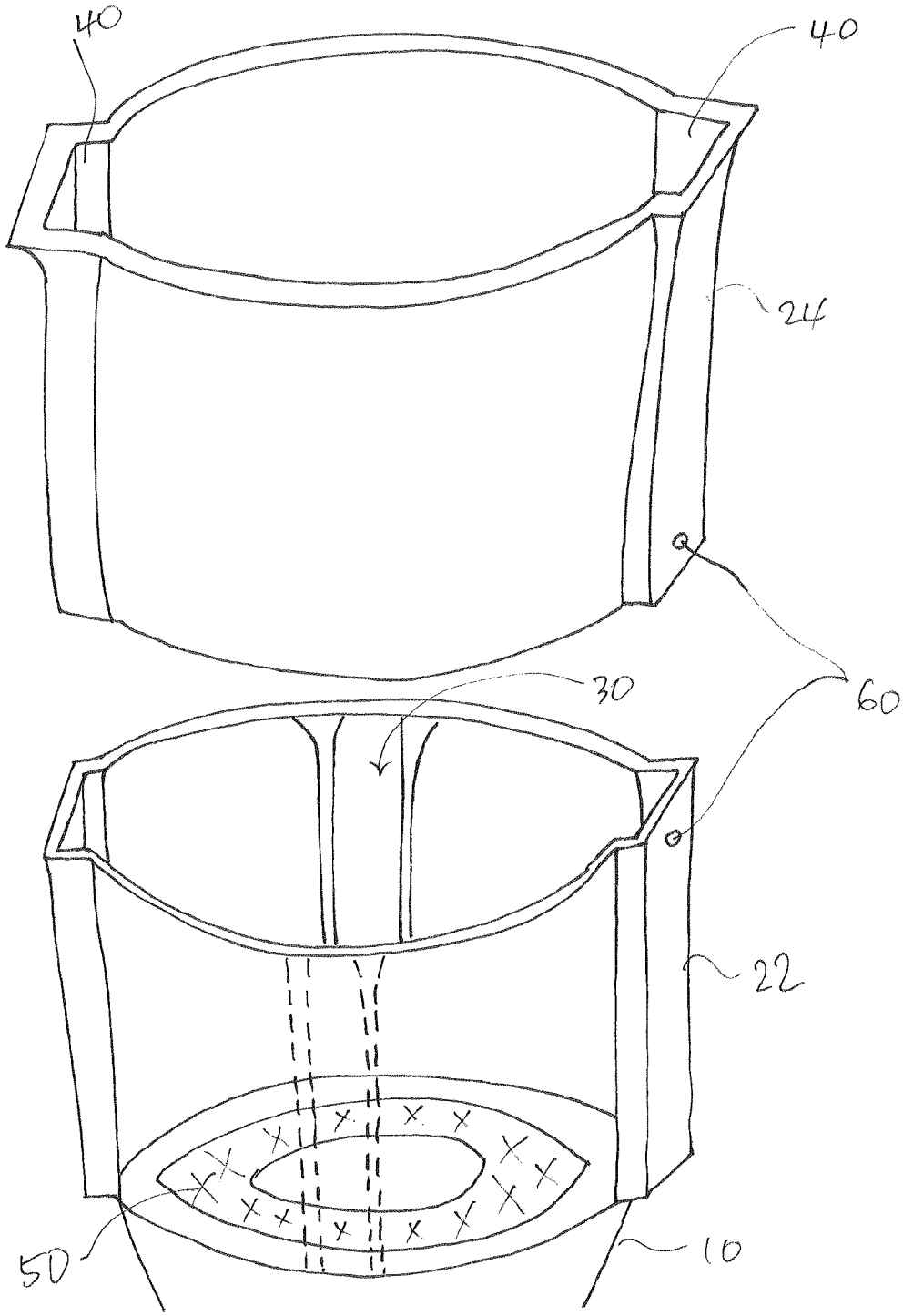
FIG. 11 is an exploded perspective view showing a cell phone sound amplifying extend cup with amplifying barrel portion disassembled.

The cell phone sound amplifying extend cup 100 may further comprise a weight portion 70 disposed around the conical trumpet portion 10 as shown in FIG. 9.

The weight portion 70 may be integrated with the conical trumpet portion 10.

Figure 7:
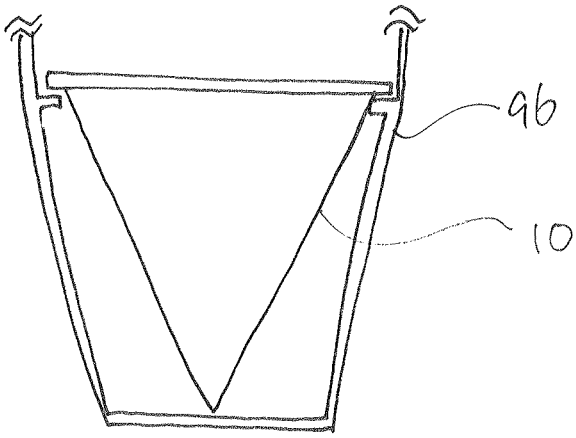
FIG. 7 is a cross-sectional view showing the conical trumpet portion installed in a cup holder according to another embodiment of the invention.

The weight portion 70 may be adapted to be inserted to a cup holder 96 of an automobile as shown in FIG. 7.

Referring to FIG. 1, the two protrusions 36 protrude inward. They are actually long protrusions extending from the top portion to the bottom portion of the amplifying barrel portion 20, between which the mobile personal communication device 90 is slid in and held there in place.

The wires 94 extending from the mobile communication device 90, 92 may be disposed through and between the amplifying barrel portion 20 and the mobile personal communication device 90. The mobile personal communication device 90 may be stopped partially by the net portion 50 and partially by the top portion of the conical trumpet portion 10. In certain embodiments, a stopper (not shown) may be formed either at the lower portion of the amplifying barrel portion 20 or at the upper portion of the conical trumpet portion 10.

Referring to FIG. 2, the lower and upper sections 22, 24 are extended fully. Of course, one of the lower and upper sections 22, 24 may be disposed around the other. That is, in certain embodiments, the lower section 22 may have a larger diameter than the upper section 24 unlike the illustrated embodiment in FIG. 2.

Figure 3:
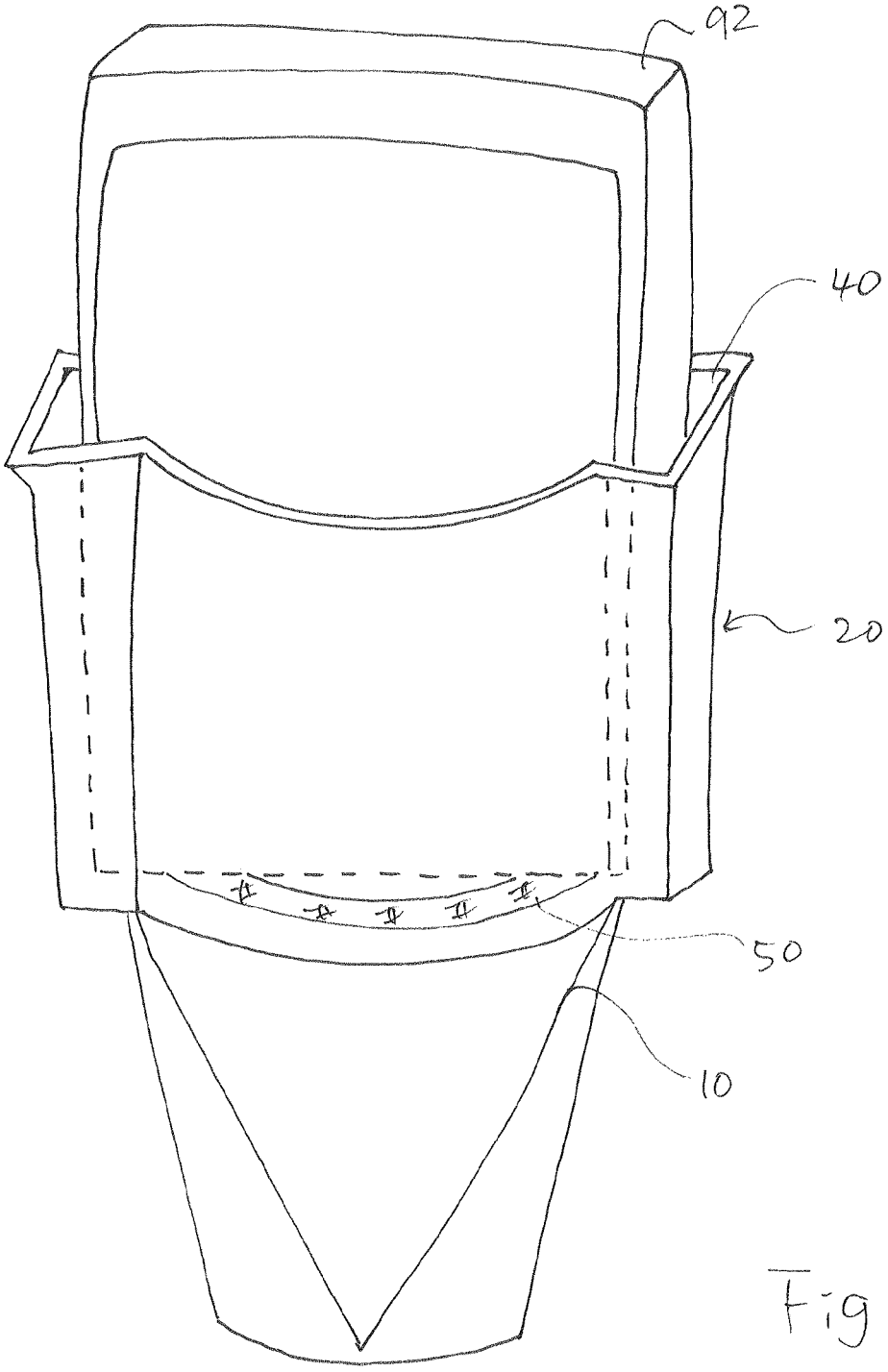
FIG. 3 is a perspective view showing a cell phone sound amplifying extend cup with a personal electronic device disposed inside according to another embodiment of the invention.

Referring to FIG. 3, the mobile personal communication device 92 of the second kind may be relatively heavier than the mobile personal communication device 90 of the first kind. Even in such cases, the extended cup 100 may be configured to stand on a floor stably, for example, by applying further weight around the conical trumpet portion 10.

Figure 4:
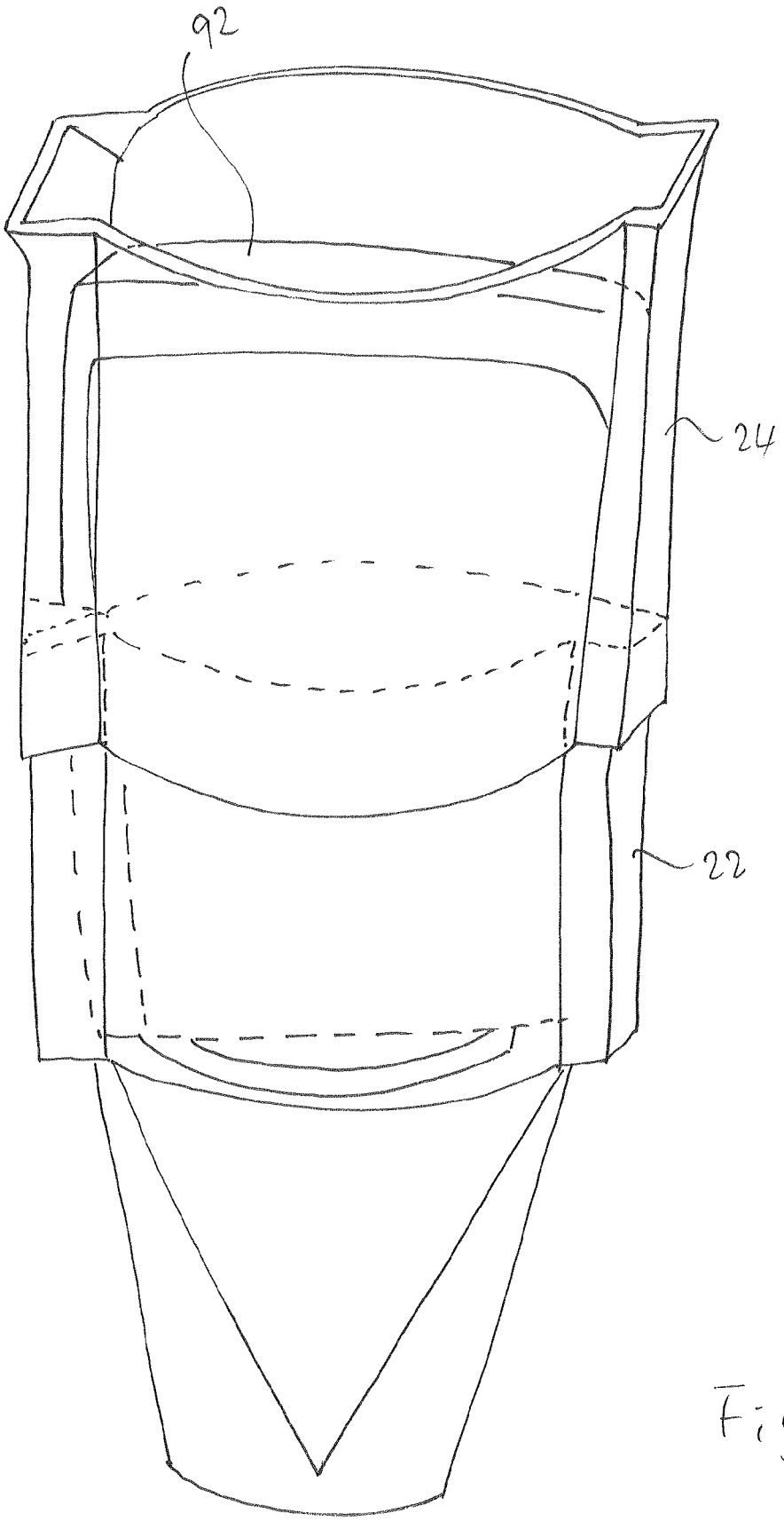
FIG. 4 is another perspective view of the cell phone sound amplifying extend cup of FIG. 3 with telescopic structure extended.

Referring to FIG. 4, the upper section 24 may have a shape for facilitating amplifying the sound from below. The diameter of the top portion of the upper section 24 may have larger diameter than the bottom portion thereof, resulting in a slightly conical shape, which is suitable to amplify and deliver the sound from below.

Referring to FIG. 5, the height of each protrusion 36 may be optimized so as to facilitate taking in and out of the mobile personal communication device 90, 92 freely and snugly. Also, the interval between the two neighboring protrusions 36 may be adjusted so as to make taking in and out and holding optimized.

Even though the extended cup 100 in FIG. 5 have two sets of receptacle portion 30, 40, one or two more sets of receptacle portions (not shown) suitable to receive mobile personal communication devices of different sizes may be further provided between the first and second receptacle portion 30, 40.

Figure 6:
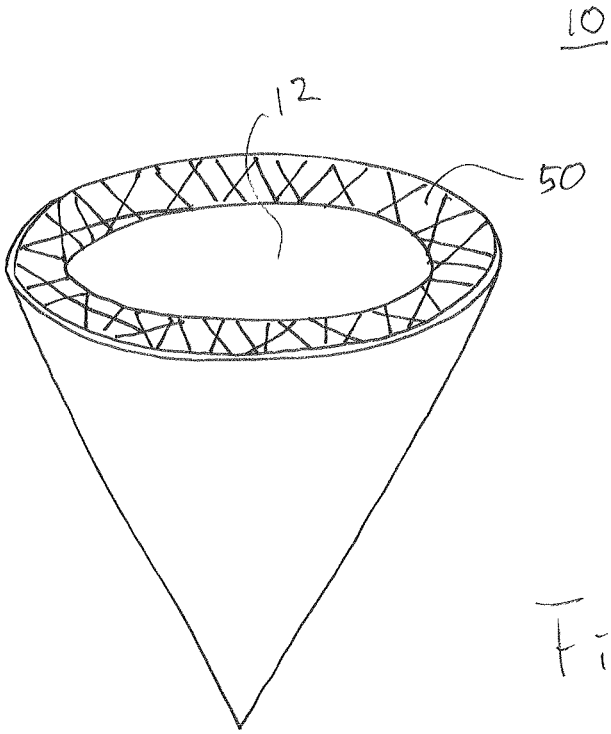
FIG. 6 is a conical trumpet portion of a cell phone sound amplifying extend cup according to another embodiment of the invention.

Referring to FIG. 6, the dimension of the conical trumpet portion 10 may be optimized for reflecting the sound from the mobile personal communication device 90, 92. Also, the material of the conical trumpet portion 10 may be optimized, too.

Referring to FIG. 7, even though the weight portion 70 is not shown clearly, it may be adapted to be fit inside the cup holder 96 of automobile.

Figure 8:
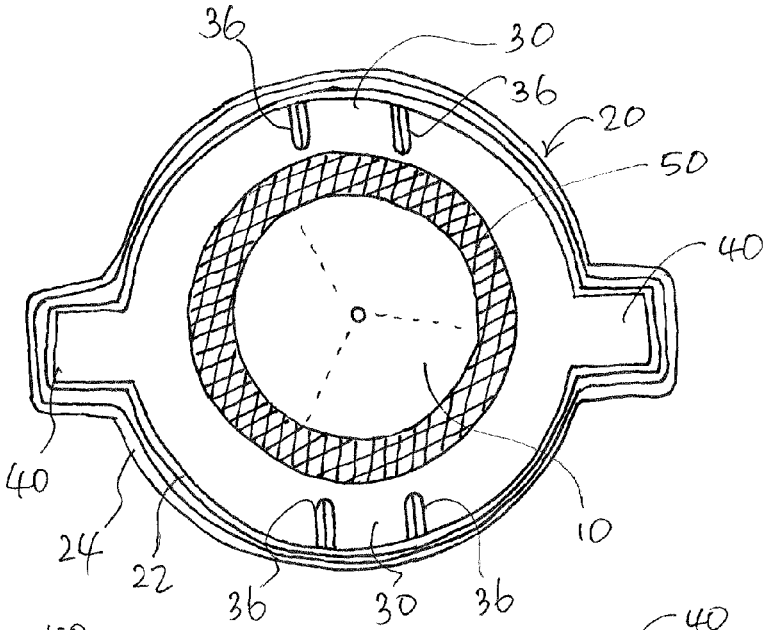
FIG. 8 is a top plan view of a cell phone sound amplifying extend cup according to another embodiment of the invention.

Referring to FIG. 8, even though the amplifying barrel portion 20 in the illustrated embodiment has two sections 22, 24, it may have more than two sections in principle.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A cell phone sound amplifying extend cup comprising:

a conical trumpet portion for collecting and reflecting sound;

an amplifying barrel portion extending from the conical trumpet portion;

a first receptacle portion disposed in the amplifying barrel portion for receiving a mobile communication device of a first kind;

a second receptacle portion disposed in the amplifying barrel portion for receiving a mobile communication device of a second kind; and a net portion disposed between the conical trumpet portion and the amplifying barrel portion for supporting the mobile communication device in place, wherein the sound from the mobile communication device is collected and reflected in the conical trumpet portion and amplified in the amplifying barrel portion, such that the sound of the mobile communication device is delivered to a user far away from the mobile communication device.

2. The cell phone sound amplifying extend cup of claim 1, wherein the conical trumpet portion has an opening in a top portion, and wherein the opening is configured for passing wires extending from the mobile communication device.

3. The cell phone sound amplifying extend cup of claim 1, wherein the amplifying barrel portion is substantially cylindrical.

4. The cell phone sound amplifying extend cup of claim 1, wherein the amplifying barrel portion is transparent.

5. The cell phone sound amplifying extend cup of claim 1, wherein the amplifying barrel portion comprises a lower section and an upper section connected in telescopic structure so as to have two states of folded and extended.

6. The cell phone sound amplifying extend cup of claim 5, wherein the amplifying barrel portion further comprises a stopper provided between the lower and upper sections for keeping the lower and upper sections from disengaging.

7. The cell phone sound amplifying extend cup of claim 6, wherein the lower section comprises an edge tilted inward.

8. The cell phone sound amplifying extend cup of claim 1, wherein the first receptacle portion comprises two edge holders in a first diametrical direction.

9. The cell phone sound amplifying extend cup of claim 8, wherein each of two edge holders comprises two protrusions protruding inward.

10. The cell phone sound amplifying extend cup of claim 1, wherein the second receptacle portion comprises two edge holders in a second diametrical direction.

11. The cell phone sound amplifying extend cup of claim 10, wherein each of two edge holders comprises two protrusions protruding outward.

12. The cell phone sound amplifying extend cup of claim 1, wherein the net portion partially covers an opening in a top portion of the conical trumpet portion.

13. The cell phone sound amplifying extend cup of claim 12, wherein the net portion is resilient.

14. The cell phone sound amplifying extend cup of claim 1, further comprising a weight portion disposed around the conical trumpet portion.

15. The cell phone sound amplifying extend cup of claim 14, wherein the weight portion is integrated with the conical trumpet portion.

16. The cell phone sound amplifying extend cup of claim 14, wherein the weight portion is adapted to be inserted to a cup holder of an automobile.

* * * * *